US010371375B2

(12) United States Patent
Yamaguchi et al.

(10) Patent No.: US 10,371,375 B2
(45) Date of Patent: Aug. 6, 2019

(54) EXHAUST STRUCTURE FOR COMBUSTION APPARATUS

(71) Applicant: NORITZ CORPORATION, Hyogo (JP)

(72) Inventors: Hideki Yamaguchi, Kobe (JP); Hidefumi Koda, Fountain Valley, CA (US)

(73) Assignee: NORITZ CORPORATION, Hyogo (JP)

( * ) Notice: Subject to any disclaimer, the term of this patent is extended or adjusted under 35 U.S.C. 154(b) by 470 days.

(21) Appl. No.: 14/799,267

(22) Filed: Jul. 14, 2015

(65) Prior Publication Data

US 2016/0025338 A1 Jan. 28, 2016

(30) Foreign Application Priority Data

Jul. 25, 2014 (JP) ..... 2014-151954

(51) Int. Cl.
*F23J 13/04* (2006.01)
*F23J 11/00* (2006.01)

(52) U.S. Cl.
CPC ..... *F23J 13/04* (2013.01); *F23J 11/00* (2013.01)

(58) Field of Classification Search
CPC ..... F23J 11/00; F23J 13/04
(Continued)

(56) References Cited

U.S. PATENT DOCUMENTS 4,481,935 A * 11/1984 Bawel ..... F23J 13/04 126/307 R
5,783,782 A * 7/1998 Sterrett ..... F01N 1/02 181/256

(Continued)

FOREIGN PATENT DOCUMENTS

JP 53-18642 U 2/1978
JP 1-60153 U 4/1989

(Continued)

OTHER PUBLICATIONS

An Office Action issued by the Japanese Patent Office dated Oct. 27, 2015, which corresponds to Japanese Patent Application No. 2014-151954 and is related to U.S. Appl. No. 14/799,267; with English language partial translation.

*Primary Examiner* — Avinash A Savani
*Assistant Examiner* — Rabeeul I Zuberi
(74) *Attorney, Agent, or Firm* — Studebaker & Brackett PC

(57) ABSTRACT

An exhaust structure for combustion apparatus includes a combustion apparatus having a combustor unit, a blower unit and a housing, an exhaust tube connected to the combustion apparatus at one end, an exhaust pipe configured to allow a part of the exhaust pipe to be introduced therein from the other end, an exhaust adapter disposed between an inner circumferential surface of the exhaust pipe and an outer circumferential surface of the exhaust tube, a connection pipe configured to communicate a region between the inner circumferential surface of the exhaust pipe and the outer circumferential surface of the exhaust tube to an inner space of the combustion apparatus, and an exhaust member connected between the combustion apparatus and the one end of the exhaust tube. The housing of the combustion
(Continued)

apparatus is provided with a connection member for connecting the connection pipe.

11 Claims, 9 Drawing Sheets

(58) Field of Classification Search
USPC ..... 126/307 R, 312, 314–316, 318; 454/1, 454/3–40
See application file for complete search history.

(56) References Cited

U.S. PATENT DOCUMENTS

| | | | | | |
|---|---|---|---|---|---|
| 6,000,391 | A * | 12/1999 | Timmons | F23J 11/02 | 110/160 |
| 2006/0211356 | A1* | 9/2006 | Grassman | F23J 13/08 | 454/4 |
| 2009/0305621 | A1* | 12/2009 | Eckardt | F24C 15/2085 | 454/63 |
| 2012/0272928 | A1* | 11/2012 | Kameyama | F24H 1/28 | 122/19.2 |

FOREIGN PATENT DOCUMENTS

| | | | |
|---|---|---|---|
| JP | 3-56036 | U | 5/1991 |
| JP | H11-101511 | A | 4/1999 |
| JP | 2012-77965 | A | 4/2012 |

* cited by examiner

EXHAUST STRUCTURE FOR COMBUSTION APPARATUS

BACKGROUND OF THE INVENTION

Field of the Invention

The present invention relates to an exhaust structure for combustion apparatus.

Description of the Background Art

A combustion apparatus such as a heating apparatus has a main body that is installed inside of a building such that an exhaust gas is emitted through an exhaust pipe (a B vent) to the outside of the building (for example, see Japanese Patent Laying-Open No. 11-101511). Upon replacing an already-placed combustion apparatus with a new combustion apparatus for certain buildings, for the purpose of reserving the outer appearance of these buildings, an already-placed exhaust pipe cannot be removed.

At such case, the combustion apparatus can be replaced without removing the already-placed exhaust pipe by introducing a new exhaust tube (a flexible exhaust tube) into the already-placed exhaust pipe. However, if the exhaust tube is relatively large in outer diameter, it cannot be installed inside the exhaust pipe. Accordingly, the exhaust tube is needed to be decreased in diameter.

Regarding the above configuration, the exhaust gas emitted out of the top of the exhaust pipe (tip end located outside) or the rain water or the like from the outside may enter into the indoor through a region between an outer circumferential surface of the exhaust tube and an inner circumferential surface of the exhaust pipe. Such problem can be solved by providing an exhaust adapter which is configured to abut against the outer circumferential surface of the exhaust tube and the inner circumferential surface of the exhaust pipe so as to fix both to each other and is configured to separate the abovementioned region and the outdoor.

However, in the above configuration provided with an exhaust adapter, in the case where the exhaust pipe is damaged at a position closer to the combustion apparatus than to a position where the exhaust adapter is installed, such a problem may occur that the exhaust gas that leaks into the abovementioned region from the damaged position of the exhaust pipe will enter into the indoor without being emitted to the outdoor.

SUMMARY OF THE INVENTION

The present invention has been made in view of the above problems, and an object thereof is to provide an exhaust structure for combustion apparatus capable of preventing an exhaust gas from leaking to the indoor.

The exhaust structure for combustion apparatus of the present invention includes a combustion apparatus, an exhaust tube, an exhaust pipe, an exhaust adapter, a connection pipe, and an exhaust member. The combustion apparatus includes a combustor unit configured to produce combustion gas, a blower unit configured to supply air for combustion to the combustor unit, and a housing configured to house therein the combustor unit and the blower unit. The exhaust pipe has one end and the other end, and is connected to the combustion apparatus at the one end. The exhaust pipe is configured to allow a part of the exhaust tube to be introduced therein from the other end. The exhaust adapter has an annular shape surrounding a through hole, and is attached to an outer circumferential surface of the exhaust tube by fitting the exhaust tube into the through hole, and attached to an inner circumferential surface of the exhaust pipe. The connection pipe is configured to communicate a region between the outer circumferential surface of the exhaust tube and the inner circumferential surface of the exhaust pipe to an inner space of the combustion apparatus. The exhaust member is connected between the combustion apparatus and the one end of the exhaust tube. The housing of the combustion apparatus is provided with a connection member for connecting the connection pipe.

According to the exhaust structure for combustion apparatus of the present invention, the region between the outer circumferential surface of the exhaust tube and the inner circumferential surface of the exhaust pipe is separated from the outdoor by the exhaust adapter. Meanwhile, the region between the outer circumferential surface of the exhaust tube and the inner circumferential surface of the exhaust pipe is communicated through the exhaust adapter to the inner space of the combustion apparatus. Thus, even in the case where the exhaust tube to be introduced inside the exhaust pipe is partially damaged and thereby the exhaust gas leaks into the region between the outer circumferential surface of the exhaust tube and the inner circumferential surface of the exhaust pipe, the exhaust gas can be guided by the connection pipe, flowing into the inner space of the combustion apparatus. This is because that in order to make the pressure in the housing of the combustion apparatus a negative pressure as compared with the outside of the combustion apparatus (i.e. the room), the inner space of the connection pipe which communicates with the inner space of the combustion apparatus at one end is also made into a negative pressure as compared with the outside of the combustion apparatus. The exhaust gas flowing into the inner space of the combustion apparatus is guided back to the exhaust tube by the fan. Therefore, it is possible to prevent the exhaust gas from leaking into the room.

In the exhaust structure for combustion apparatus mentioned above, the connection pipe is configured to allow a part of the exhaust tube to be introduced therein from one end, and the connection member is disposed so as to surround the exhaust member.

According to the abovementioned configuration, even in the case where a part of the exhaust tube introduced inside the connection pipe is damaged and thereby the exhaust gas leaks into the region between the outer circumferential surface of the exhaust tube and the inner circumferential surface of the exhaust pipe, the exhaust gas that leaks into the region can be guided by the connection pipe back to the inner space of the combustion apparatus. Therefore, it is possible to prevent the exhaust gas from leaking into the room.

In the exhaust structure for combustion apparatus mentioned above, the connection pipe is flexible. Since the connection pipe is flexible, it is easy to make the connection pipe to follow the shape of the exhaust tube.

The exhaust structure for combustion apparatus mentioned above is provided with a fixing member configured to fix the exhaust pipe and the exhaust tube to each other. The fixing member is connected by the connection pipe, and is provided with a communication hole configured to communicate the region between the outer circumferential surface of the exhaust tube and the inner circumferential surface of the exhaust pipe to the inner space of the connection pipe.

According to the abovementioned configuration, the exhaust pipe and the exhaust tube can be fixed to each other by the fixing member. Thus, it is possible to prevent the exhaust pipe and the exhaust tube from contacting each other and prevent the exhaust tube from dropping, for example.

In the exhaust structure for combustion apparatus mentioned above, the combustion apparatus is a water heater of an exhaust suction and combustion type. A water heater of an exhaust suction and combustion type can maintain a stable combustion state even when the exhaust tube is made smaller in diameter.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, embodiments of the present invention will be described with reference to the drawings.

First Embodiment

The configuration of an exhaust structure for combustion apparatus according to a first embodiment serving as one embodiment of the present invention will be described with reference to FIGS. 1 to 6.

Figure 1:
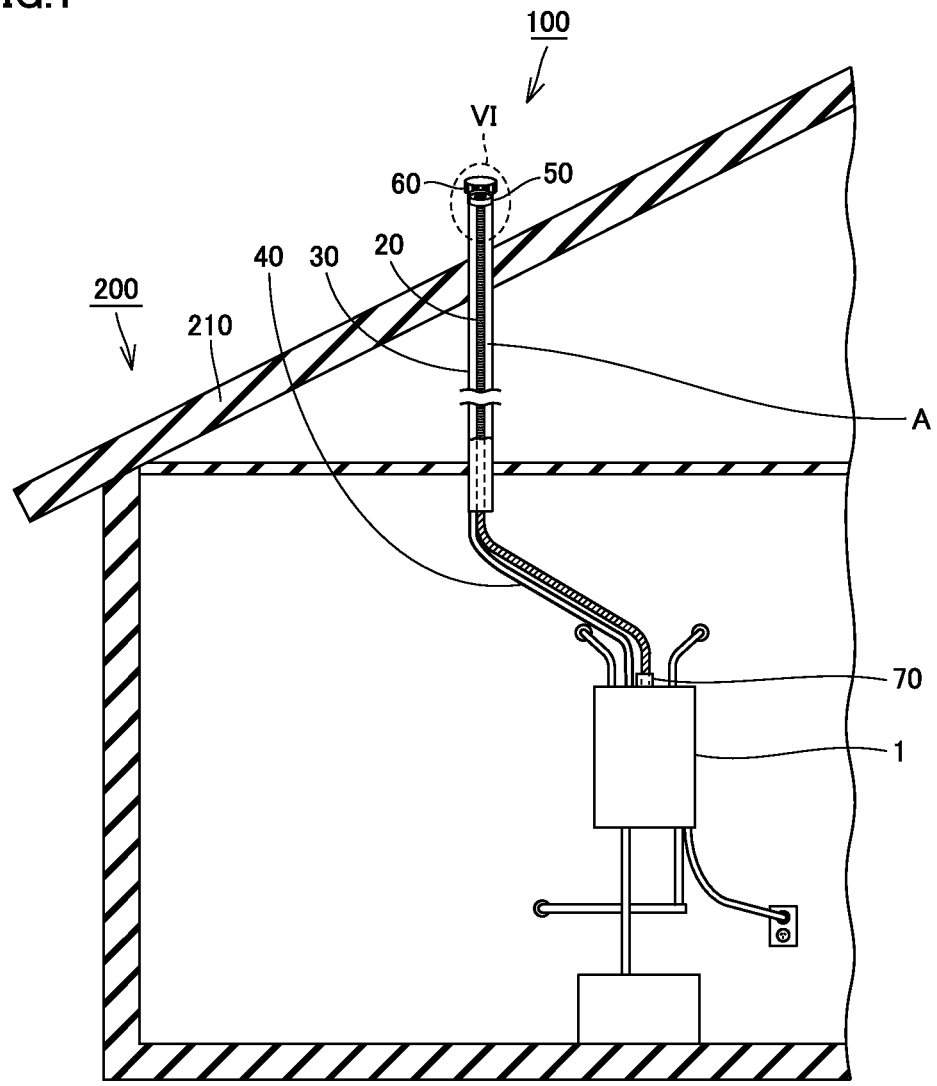
FIG. 1 is a schematic view schematically illustrating a state in which an exhaust structure for combustion apparatus according to a first embodiment is installed in a building.

Referring mainly to FIG. 1, an exhaust structure for combustion apparatus 100 of the present embodiment mainly includes a combustion apparatus 1, an exhaust tube 20, an exhaust pipe 30, a connection pipe 40, an exhaust adapter 50, an exhaust terminal (rain cap) 60, and an exhaust member 70. This exhaust structure for combustion apparatus 100 is configured to emit combustion gas produced in combustion apparatus 1 to the outside of a building 200.

Figure 2:
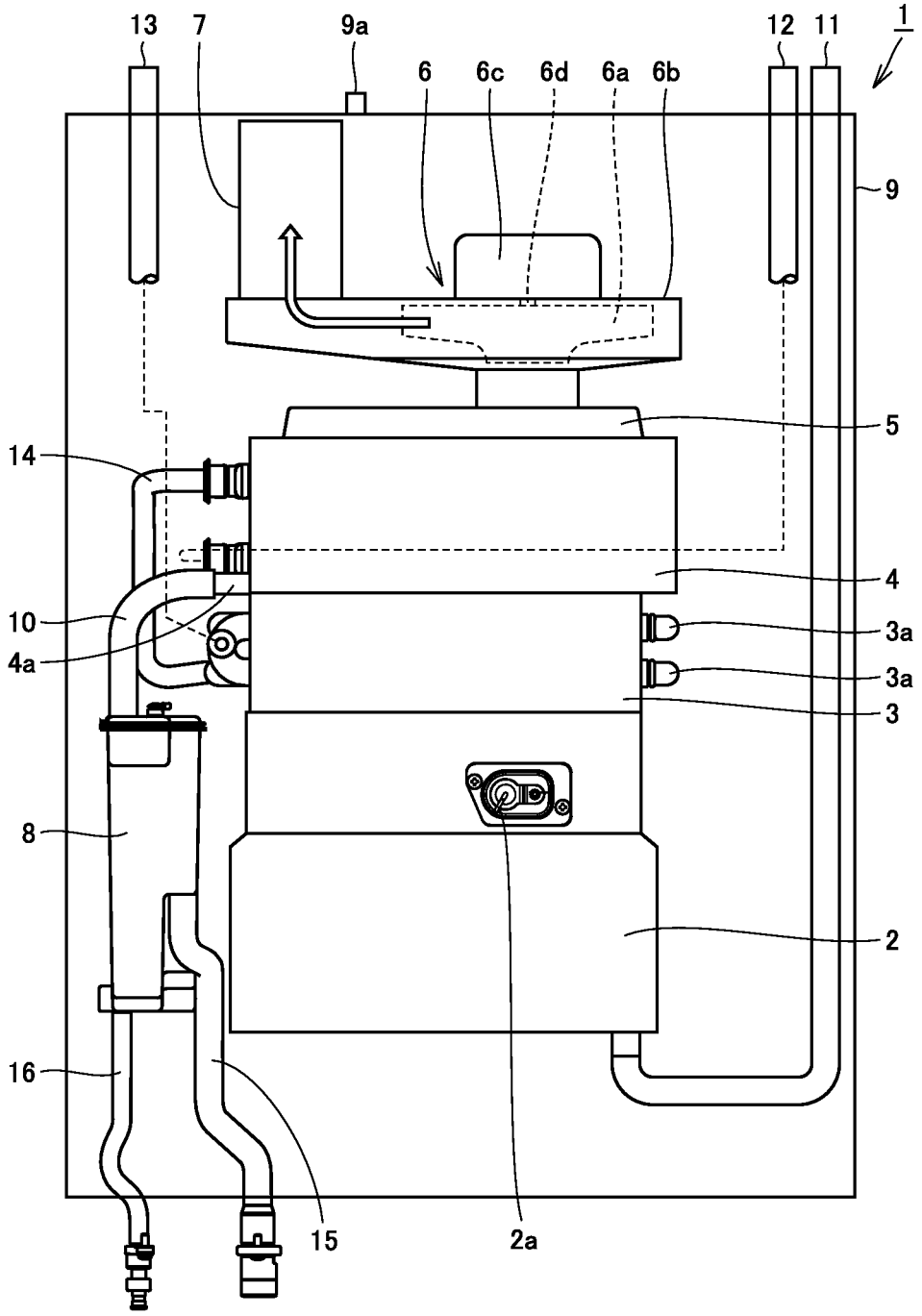
FIG. 2 is a front view schematically illustrating the configuration of a combustion apparatus included in the exhaust structure for combustion apparatus according to the first embodiment.
Figure 3:
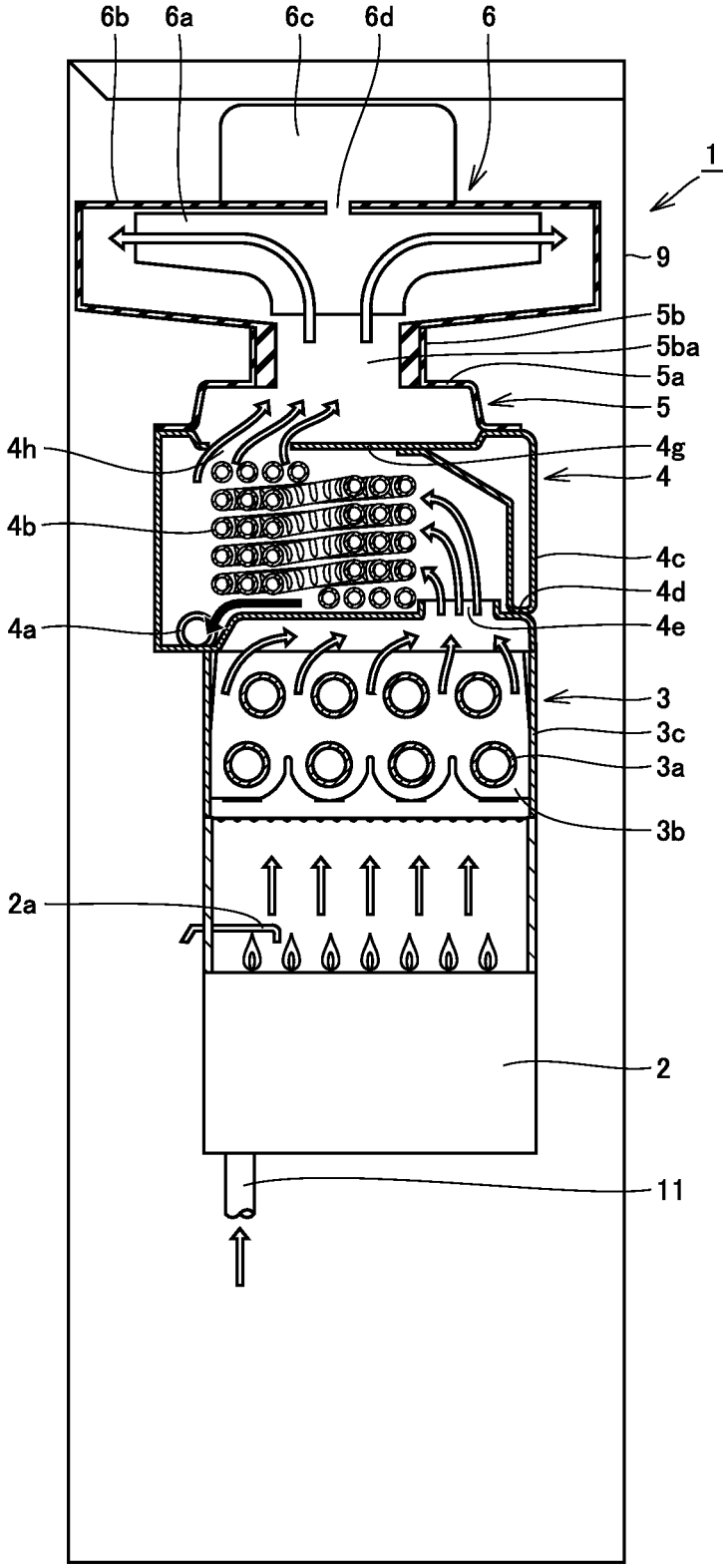
FIG. 3 is a partial cross-sectional side view schematically illustrating the configuration of the combustion apparatus illustrated in FIG. 2.

Referring mainly to FIGS. 2 and 3, combustion apparatus 1 is a water heater of a latent heat recovery type adapted to an exhaust suction and combustion system. Combustion apparatus 1 mainly includes a burner (combustor unit) 2, a primary heat exchanger 3, a secondary heat exchanger 4, an exhaust box 5, a fan (blower unit) 6, an exhaust connection pipe 7, a drainage water tank 8, a housing 9, and pipes 10 to 16.

Referring mainly to FIG. 2, burner 2 is configured to produce combustion gas by burning fuel gas. A gas supply pipe 11 is connected to burner 2. Gas supply pipe 11 is configured to supply fuel gas to burner 2. A gas valve (not shown) implemented, for example, by an electromagnetic valve is attached to this gas supply pipe 11.

A spark plug 2*a* is disposed above burner 2. This spark plug 2*a* is configured to ignite an air fuel mixture injected from burner 2 to thereby produce a flame, by generating sparks between the plug and a target (not shown) provided in burner 2. Burner 2 produces a quantity of heat by burning fuel gas supplied from gas supply pipe 11 (which is called a combustion operation).

Referring mainly to FIGS. 2 and 3, primary heat exchanger 3 is a heat exchanger of a sensible heat recovery type. This primary heat exchanger 3 mainly includes a plurality of plate-shaped fins 3*b*, a heat conduction pipe 3*a* penetrating the plurality of plate-shaped fins 3*b*, and a case 3*c* accommodating fins 3*b* and heat conduction pipe 3*a*. Primary heat exchanger 3 exchanges heat with the combustion gas produced by burner 2, and specifically, it is configured to heat hot water and water which flows through heat conduction pipe 3*a* of primary heat exchanger 3 with the amount of heat produced as a result of the combustion operation by burner 2.

Referring mainly to FIGS. 2 and 3, secondary heat exchanger 4 is a heat exchanger of a latent heat recovery type. This secondary heat exchanger 4 is located downstream of primary heat exchanger 3 in a flow of the combustion gas and connected in series with primary heat exchanger 3. Since combustion apparatus 1 according to the present embodiment thus includes secondary heat exchanger 4 of a latent heat recovery type, it serves as a water heater of a latent heat recovery type.

Secondary heat exchanger 4 mainly includes a drainage water discharge port 4*a*, heat conduction pipes 4*b*, a sidewall 4*c*, a bottom wall 4*d*, and an upper wall 4*g*. Heat conduction pipes 4*b* are layered as they are spirally wound. Sidewall 4*c*, bottom wall 4*d* and upper wall 4*g* are arranged to surround heat conduction pipes 4*b*.

In secondary heat exchanger 4, hot water and water which flows through heat conduction pipes 4*b* are pre-heated (heated) through heat exchange with the combustion gas of which heat has been exchanged in primary heat exchanger 3. As a temperature of the combustion gas is lowered to approximately 60° C. through this process, the moisture contained in the combustion gas is condensed so that the latent heat can be obtained. In addition, the latent heat is recovered in secondary heat exchanger 4 and moisture contained in the combustion gas is condensed, whereby drainage water is produced.

Bottom wall 4*d* serves as a partition between primary heat exchanger 3 and secondary heat exchanger 4, and it also serves as an upper wall of primary heat exchanger 3. This bottom wall 4*d* is provided with an opening 4*e*, and this opening 4*e* allows communication between a space where heat conduction pipe 3*a* of primary heat exchanger 3 is arranged and a space where heat conduction pipes 4*b* of secondary heat exchanger 4 are arranged. As shown by the hollow arrows in FIG. 3, the combustion gas can flow from primary heat exchanger 3 to secondary heat exchanger 4 through opening 4*e*. In this embodiment, for the sake of simplification, although one common component is employed for bottom wall 4*d* of secondary heat exchanger 4 and the upper wall of primary heat exchanger 3, an exhaust collection and guide member may be connected between primary heat exchanger 3 and secondary heat exchanger 4.

Upper wall 4*g* is provided with an opening 4*h*, and this opening 4*h* allows communication between the space where heat conduction pipes 4*b* of secondary heat exchanger 4 are arranged and an inner space in exhaust box 5. As shown by the hollow arrows in FIG. 3, the combustion gas can flow from secondary heat exchanger 4 into the inner space in exhaust box 5 through opening 4*h*.

Drainage water discharge port 4*a* is provided in sidewall 4*c* or bottom wall 4*d*. This drainage water discharge port 4*a* opens at a lowest position in the space surrounded by side wall 4*c*, bottom wall 4*d* and upper wall 4*g* (the lowermost position in the vertical direction in the state where the water heater is installed), which is lower than the lowermost portion of heat conduction pipes 4*b*. Thus, drainage water produced in secondary heat exchanger 4 can be guided to drainage water discharge port 4*a* along bottom wall 4*d* and sidewall 4*c* as shown by a black arrow in FIG. 3.

Referring mainly to FIGS. 2 and 3, exhaust box 5 forms a path for a flow of the combustion gas between secondary heat exchanger 4 and fan 6. This exhaust box 5 can guide, to fan 6, the combustion gas of which heat has been exchanged in secondary heat exchanger 4. Exhaust box 5 is attached to secondary heat exchanger 4 and located downstream of secondary heat exchanger 4 in the flow of the combustion gas.

Exhaust box 5 mainly includes a box main body 5*a* and a fan connection member 5*b*. An inner space in box main body 5*a* communicates through opening 4*h* in secondary heat exchanger 4 with the inner space where heat conduction pipes 4*b* of secondary heat exchanger 4 are arranged. Fan connection member 5*b* is provided so as to protrude from an upper portion of box main body 5*a*. This fan connection member 5*b* has, for example, a cylindrical shape, and an inner space 5*ba* thereof communicates with the inner space in box main body 5*a*.

Referring mainly to FIGS. 2 and 3, fan 6 is configured to emit the combustion gas (of which heat has been exchanged in secondary heat exchanger 4), which has passed through secondary heat exchanger 4, to the outside of combustion apparatus 1 by suctioning the combustion gas, and is connected to exhaust connection pipe 7.

This fan 6 is located downstream of exhaust box 5 and secondary heat exchanger 4 in the flow of the combustion gas. Namely, in combustion apparatus 1, burner 2, primary heat exchanger 3, secondary heat exchanger 4, exhaust box 5, and fan 6 are arranged in this order from upstream to downstream in the flow of the combustion gas produced in burner 2. Since the combustion gas is suctioned and exhausted by means of fan 6 as above in this arrangement, combustion apparatus 1 in the present embodiment is a water heater adapted to the exhaust suction and combustion system.

Fan 6 mainly includes a impeller 6*a*, a fan case 6*b*, a drive source 6*c*, and a rotation shaft 6*d*. Fan case 6*b* is attached to fan connection member 5*b* of exhaust box 5 such that the inner space in fan case 6*b* and the inner space in fan connection member 5*b* communicate with each other. Thus, as shown by the hollow arrows in FIGS. 2 and 3, the combustion gas can be suctioned from box main body 5*a* of exhaust box 5 through fan connection member 5*b* into fan case 6*b*.

Impeller 6*a* is arranged in fan case 6*b*. This impeller 6*a* is connected to drive source 6*c* with rotation shaft 6*d* interposed therebetween. Thus, impeller 6*a* is provided with drive force from drive source 6*c* and can rotate around rotation shaft 6*d*. By rotation of impeller 6*a*, the combustion gas in exhaust box 5 can be suctioned from the inner circumferential side of impeller 6*a* and can be emitted to the outer circumferential side of impeller 6*a*.

Referring mainly to FIGS. 2 and 3, exhaust connection pipe 7 is connected to the outer circumferential side of fan case 6*b*. Exhaust connection pipe 7 is further connected to exhaust member 70, and since exhaust tube 20 is connected to exhaust member 70, exhaust pipe 7 is communicated with exhaust tube 20. Therefore, the combustion gas emitted to the outer circumferential side by impeller 6*a* of fan 6 can be emitted to the outside through exhaust connection pipe 7 and exhaust tube 20.

Namely, the combustion gas produced by burner 2 is suctioned by fan 6 by rotation of impeller 6*a* described in the above, so that the combustion gas can reach fan 6 after passage through primary heat exchanger 3, secondary heat exchanger 4 and exhaust box 5 in this order as shown by the hollow arrows in FIGS. 2 and 3, and can be emitted to the outside of combustion apparatus 1 (the exhaust structure for combustion apparatus 100).

Figure 4:
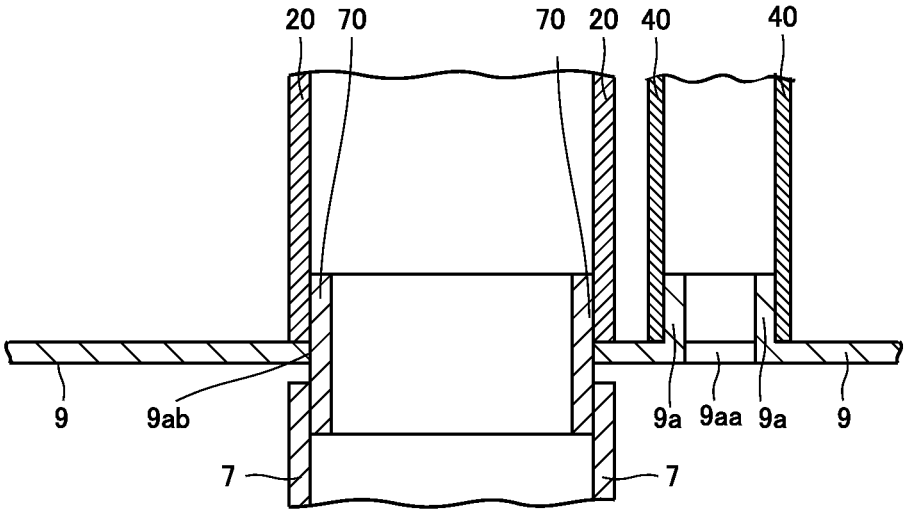
FIG. 4 is a schematic sectional view illustrating the configurations of an exhaust member and a connection member included in the combustion apparatus for exhaust structure according to the first embodiment.

Referring mainly to FIGS. 2 and 4, housing 9 is provided to house therein burner 2, primary heat exchanger 3, secondary heat exchanger 4, exhaust box 5, fan 6, and exhaust connection pipe 7, and drainage water tank 8.

Referring mainly to FIG. 4, the upper surface of housing 9 is disposed with a connection port 9*aa* and a tubular connection member 9*a* surrounding connection port 9*aa* and protruding from the upper surface of housing 9 to the outside of housing 9. Connection member 9*a* is connected to connection pipe 40, and thereby, the inner space of connection pipe 40 and the inner space of housing 9 (i.e., the inner space of combustion apparatus 1) are communicated.

Referring mainly to FIG. 2, drainage water tank 8 is configured to accumulate the drainage water generated in secondary heat exchanger 4. Drainage water tank 8 and a drainage water port 4*a* of secondary heat exchanger 4 are connected by a drainage water discharge pipe 10. Usually, the acidic drainage water accumulated in drainage water tank 8 is, for example, discharged to the outside of combustion apparatus 1 from a drainage water discharge piping 15 after being temporarily stored in the inner space of drainage water tank 8.

In addition, the lower portion of drainage water tank 8 is connected to a drainage water drain piping 16, separately from drainage water discharge piping 15. Drainage water drain piping 16 (which is normally closed) is configured to be opened for example during maintenance so as to discharge the drainage water which is accumulated in drainage water tank 8 and cannot be discharged through drainage water discharge piping 15. Optionally, the inner space of drainage water tank 8 may be filled with a neutralizing agent (not shown) to neutralize the acidic drainage water.

Referring mainly to FIG. 2, gas supply pipe 11 is connected to burner 2. A water supply pipe 12 is connected to heat conduction pipes 4*b* (see FIG. 3) of secondary heat exchanger 4, and a hot water delivery pipe 13 is connected to heat conduction pipe 3*a* (see FIG. 3) of primary heat exchanger 3. Heat conduction pipe 3*a* of primary heat exchanger 3 and heat conduction pipes 4*b* of secondary heat exchanger 4 are connected to each other through a connection pipe 14. Each of gas supply pipe 11, water supply pipe 12 and hot water delivery pipe 13 described above leads to the outside, for example, in a top portion of combustion apparatus 1.

In the above, the description has been carried out mainly on the configuration of combustion apparatus 1 of the exhaust structure for combustion apparatus 100. Hereinafter, the description will be carried out on exhaust member 70, exhaust tube 20, exhaust pipe 30, connection pipe 40, exhaust adapter 50 and exhaust terminal 60.

Referring mainly to FIGS. 2 and 4, exhaust member 70 is configured to connect combustion apparatus 1 and one end (the lower part in FIG. 1) of exhaust tube 20 for guiding the combustion gas emitted from combustion apparatus 1 to exhaust tube 20. Specifically, tubular exhaust member 70 is connected to combustion apparatus 1 in a manner of penetrating the upper surface of housing 9. A portion of exhaust member 70 which projects outside housing 9 is connected to one end of exhaust tube 20, and a portion of exhaust member 70 which projects inside housing 9 is connected to exhaust connection pipe 7 housed in housing 9.

The above configuration may be obtained, for example, in such a manner that an exhaust port 9*ab* is provided on the upper surface of housing 9, exhaust member 70 is introduced through exhaust port 9*ab*, and one end of exhaust member 70 located inside housing 9 is connected to exhaust connection pipe 7 (see FIG. 4). Thus, the inner space of exhaust connection pipe 7 and the inner space of exhaust member 70 are communicated to the inner space of exhaust tube 20.

Exhaust member 70 and exhaust tube 20 may be connected in such a manner that no gas flowing inside will leak out. The same applies to exhaust member 70 and exhaust connection pipe 7. Thus, an O-ring may be interposed between the two connected parts or a binding band may be used to firmly bind the two connected parts. The two parts may be outer attached or inner attached to each other.

Referring mainly to FIGS. 1 and 4, exhaust tube 20 is configured to guide the exhaust gas generated in combustion apparatus 1 to the outside. Specifically, exhaust tube 20 has one end (the lower end in FIG. 1) and the other end (the upper end in FIG. 1), and as described above, is connected to combustion apparatus 1 through the connection to exhaust member 70 at the one end. Moreover, a part of exhaust tube 20 is introduced into exhaust pipe 30 from the other end. In other words, exhaust tube 20 has a smaller diameter than exhaust pipe 30.

From the consideration of installation approach that a part of exhaust tube 20 is introduced into the already-placed exhaust pipe 30, it is preferable that exhaust tube 20 is flexible. Thus, even in the case where exhaust pipe 30 has a complicated shape, it is possible for exhaust tube 20 to follow the shape of exhaust pipe 30, making the introduction into the interior of exhaust pipe 30 easier. From the consideration that the exhaust gas flows through the inside of exhaust tube 20, exhaust tube 20 should be suitably made of a material having acidic resistance. Since in the case where combustion apparatus 1 is a water heater of a latent heat recovery type as in the present embodiment, the acidic drainage water may be discharged together with the exhaust gas.

Accordingly, exhaust tube 20 can be made of a material having acidic resistance such as phenol resin, epoxy resin, silicone resin, fluorine resin such as polytetrafluoroethylene, unsaturated polyester resin, melamine resin, polycarbonate resin, methacryl styrene (MS) resin, methacryl resin, styrene acrylonitrile copolymer (AS) resin, ABS resin, polyethylene, polypropylene, polystyrene, polyethylene terephthalate (PET), or vinyl chloride resin, for example.

Referring mainly to FIG. 1, exhaust pipe 30 has one end (the lower end in FIG. 1) and the other end (the upper end in FIG. 1). One end of exhaust pipe 30 is located inside building 200, and the other end of exhaust pipe 30 is located outside building 200. In other words, exhaust pipe 30 is installed so as to extend from the inside of building 200 to the outside thereof. This exhaust pipe 30, for example, has already been installed in building 200.

Figure 5:
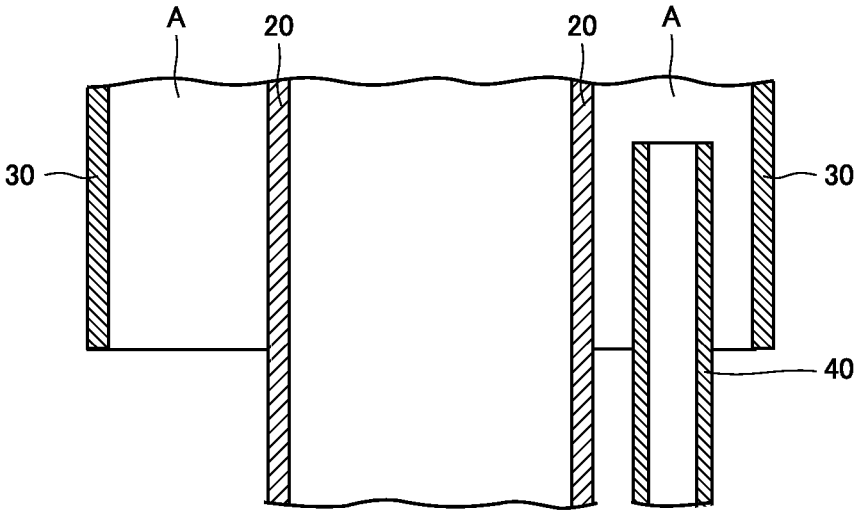
FIG. 5 is a schematic sectional view illustrating the arrangement of an exhaust tube, an exhaust pipe and a connection pipe included in the exhaust structure for combustion apparatus according to the first embodiment.

Referring mainly to FIGS. 1, 4 and 5, connection pipe 40 has one end (the lower end in FIG. 1) and the other end (the upper end in FIG. 1). One end of connection pipe 40 is connected to connection member 9*a* of combustion apparatus 1 (see FIG. 4), and the other end of connection pipe 40 is inserted into a region A (see FIG. 1) between the outer circumferential surface of exhaust tube 20 and the inner circumferential surface of exhaust pipe 30 (see FIG. 5). Thus, region A and the inner space of connection pipe 40 and the interior of combustion apparatus 1 (the inner space of housing 9) are communicated to each other.

It is preferable that connection pipe 40 is flexible. Since connection pipe 40 is flexible, it is possible for it to follow the shape of exhaust tube 20 or the shape of exhaust pipe 30, which thereby increases the degree of freedom of arranging combustion apparatus 1.

For example, connection pipe 40 may be implemented as an accordion pipe, which allows it to have a high flexibility. Further, connection pipe 40 may be made of aluminum, for example. In this case, the self weight of connection pipe 40 can be reduced, and since connection pipe 40 has a certain degree of hardness, the deformation of connection pipe 40 caused by its self weight can be suppressed. Furthermore, since a pipe made of aluminum can be relatively readily processed through cutting or the like, it can be readily adapted to the length of exhaust tube 20, for example.

Figure 6:
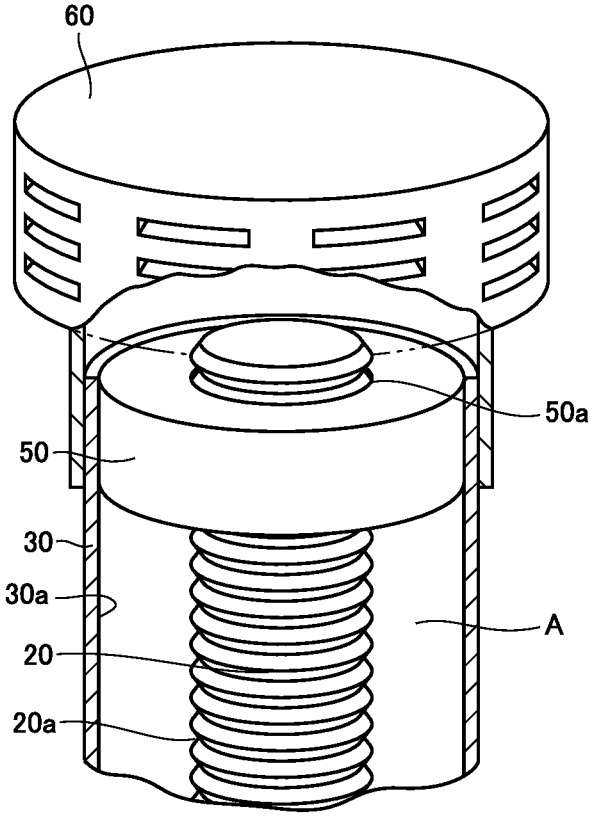
FIG. 6 is a partially cutaway perspective view illustrating an enlarged region VI in FIG. 1.

Referring mainly to FIGS. 1 and 6, exhaust adapter 50 has an annular shape surrounding a through hole 50*a*. Exhaust adapter 50 is attached to outer circumferential surface 20*a* of exhaust tube 20 by fitting exhaust tube 20 into through hole 50*a*, and also attached to inner circumferential surface 30*a* of exhaust pipe 30. Accordingly, region A between the inner circumferential surface of exhaust pipe 30 and the outer circumferential surface of exhaust tube 20 is separated from the outside (outdoor) of the exhaust structure for combustion apparatus 100, and meanwhile, exhaust tube 20 and exhaust pipe 30 are fixed to each other.

For example, while the outer circumferential surface of exhaust adapter 50 is being fitted on inner circumferential surface 30*a* of exhaust pipe 30 and the inner circumferential surface of exhaust adapter 50 is being fitted on outer circumferential surface 20*a* of exhaust tube 20, the inner circumferential surface of exhaust adapter 50 presses against outer circumferential surface 20*a* of exhaust tube 20, and the outer circumferential surface of exhaust adapter 50 presses against inner circumferential surface 30*a* of exhaust pipe 30.

The above-described configuration can be readily achieved, for example, by preparing exhaust adapter 50 from an elastic material. This elastic material is for example preferably a soft resin, or for example preferably EPDM (Ethylene-Propylene-Diene Monomer), soft PVC (polyvinyl chloride), Gore-Tex (registered trademark), SOFLEX (registered trademark), silicone rubber, fluororubber, chloroprene rubber (CR), butyl rubber (IIR), or the like. Furthermore, exhaust adapter 50 may be made of one elastic material, or may be made of a combination of a plurality of elastic materials of different types.

Consequently, the outer circumferential surface of exhaust adapter 50 comes into close contact with inner circumferential surface 30*a* of exhaust pipe 30, and meanwhile, the inner circumferential surface of exhaust adapter 50 comes into close contact with outer circumferential surface 20*a* of exhaust tube 20. Accordingly, exhaust adapter 50 can firmly fix exhaust tube 20 and exhaust pipe 30 to each other, and can also prevent the exhaust gas which has been emitted out of the other end (the upper end) of exhaust tube 20 from flowing back into the room through region A, and further prevent the rain water or the like from entering region A from the outside.

Referring mainly to FIG. 6, exhaust terminal 60 is attached to a tip of the other end (the upper end) of exhaust pipe 30. Exhaust terminal 60 may be an outer cover attached to the outer circumferential surface of exhaust pipe 30 or may be an inner cover attached to the inner circumferential surface of exhaust pipe 30. Thus, the exhaust gas guided through exhaust tube 20 is allowed to be emitted from exhaust terminal 60 to the outside of building 200.

Then, the functions and effects of the exhaust structure for combustion apparatus of the present embodiment will be described.

As described above, in the case where an already-placed combustion apparatus inside a building is replaced with a new combustion apparatus, the already-placed exhaust pipe is left unremoved and a new exhaust tube is introduced into the already-placed exhaust pipe so as to achieve the replacement of the combustion apparatus. In other words, the exhaust gas produced in the combustion apparatus is guided through the exhaust tube introduced into the exhaust pipe and emitted to the outside of the building.

However, in the case where the exhaust tube is simply introduced into the exhaust pipe, due to the shaking or displacement of the exhaust tube, a friction may occur between the exhaust tube and the exhaust pipe, causing dirt to fall from the exhaust pipe or causing damage to the exhaust pipe. Further, since it is necessary for the combustion apparatus to support the whole weight of the exhaust pipe, the load on the combustion apparatus is great. Furthermore, the exhaust gas emitted from the upper end of the exhaust tube may flow back into the indoor through the region between the inner circumferential surface of the exhaust pipe and the outer circumferential surface of the exhaust tube, and the rain water or the like may also enter indoors from the region.

In this regard, according to the exhaust structure for combustion apparatus 100 of the present embodiment, exhaust adapter 50 is configured to fix exhaust tube 20 and exhaust pipe 30 to each another and separate region A from the outside. Further, since the load, which is caused by the weight of exhaust tube 20, applied to combustion apparatus 1 is shared by exhaust adapter 50, the load on combustion apparatus 1 as described in the above can be reduced. Furthermore, the exhaust gas emitted from the other end of exhaust tube 20, and the rain water or the like can be prevented from flowing back or entering into the indoor side through region A between the inner circumferential surface of exhaust pipe 30 and the outer circumferential surface of exhaust tube 20 by exhaust adapter 50.

Further, in the exhaust structure for combustion apparatus 100, region A is in communication with the inner space of housing 9 of combustion apparatus 1. Specifically, connection pipe 40 is arranged in such a manner that one end is connected to connection member 9*a* provided on housing 9, and the other end is introduced into region A. Connection member 9*a* is opened with connection port 9*aa*. Thus, region A and the inner space of housing 9 are communicated to each other via the inner space of connection pipe 40.

In the present embodiment, combustion apparatus 1 is a water heater of a latent heat recovery type adapted to an exhaust suction and combustion system. Therefore, the pressure in housing 9 of combustion apparatus 1 is a negative pressure as compared with the outside of combustion apparatus 1 (i.e. the room). Thus, the inner space of connection pipe 40 which communicates with the inner space of combustion apparatus 1 at one end is also a negative pressure as compared with the outside of combustion apparatus 1.

According to the abovementioned configuration, even in the case where a part of exhaust tube 20 introduced inside exhaust pipe 30 is damaged and thereby the exhaust gas leaks from the damaged location into region A, the leaked exhaust gas can be sucked into the inner space of connection pipe 40 by the negative pressure. The exhaust gas sucked into the inner space of connection pipe 40 is guided into the inner space of housing 9 via connection port 9*aa*. Therefore, according to the exhaust structure for combustion apparatus 100 of the present embodiment, even in the case where exhaust tube 20 introduced into exhaust pipe 30 is damaged or the like, it is still possible to prevent the exhaust gas from leaking into the room.

Since it is difficult to visually check the outer appearance of the part of exhaust tube 20 which has been introduced into exhaust pipe 30, if this part of exhaust tube 20 is damaged or the like, compared to the other part of exhaust tube 20, usually it is difficult to be detected and repaired early.

In this regard, according to the exhaust structure for combustion apparatus 100 of the present embodiment, as described above, even in the case where the part of exhaust tube 20 which has been introduced into exhaust pipe 30 is damaged or the like, since the exhaust gas flowing out from exhaust tube 20 into region A can be guided into the inner space of housing 9, the adverse effects (for example, the continuation of leakage) caused by the late detection of damage can be avoided.

Further in the present embodiment, as described above, since the used combustion apparatus 1 is a water heater adapted to an exhaust suction and combustion system, even when exhaust tube 20 is made smaller in diameter, the combustion operation by burner 2 can be stabilized for the water heater of the so-called forced exhaust type, which will be described hereinafter.

In the water heater of the so-called forced exhaust type, a fan, a burner, a primary heat exchanger, and a secondary heat exchanger are arranged in this order from upstream to downstream in the flow of the combustion gas. In other words, the combustion gas produced by the burner is guided by the fan to flow through the primary heat exchanger and the secondary heat exchanger into the exhaust tube provided outside the water heater.

The combustion gas pushed out by the fan is subjected to flow path resistance caused by the primary heat exchanger and the secondary heat exchanger before this combustion gas reaches the exhaust tube. Accordingly, the blast pressure of the combustion gas immediately in front of the exhaust tube is lowered by this flow path resistance. For this reason, the blast pressure caused by the fan should be raised in order to push the combustion gas into the exhaust tube having a relatively small diameter. However, when the blast pressure of the fan is raised, the internal pressure within the case of the burner is raised. Consequently, in the case where the fuel gas is supplied to the burner at relatively low pressure, the combustion operation becomes unstable.

On the other hand, according to the water heater adapted to the exhaust suction and combustion system in the present embodiment, burner 2, primary heat exchanger 3, secondary heat exchanger 4, and fan 6 are arranged in this order from upstream to downstream in the flow of the combustion gas. In this system, negative pressure occurs on the upstream side of fan 6, which eliminates the need to raise the blast pressure of fan 6. Accordingly, even in the case where exhaust tube 20 is made smaller in diameter, the internal pressure within the burner case can be maintained low. Therefore, the combustion operation can be stabilized even if the fuel gas is supplied to burner 2 at a relatively low pressure.

Figure 7:
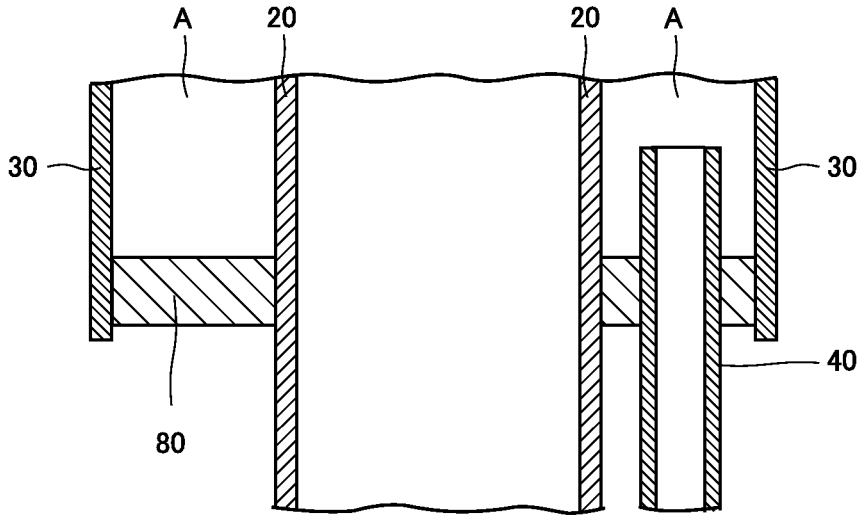
FIG. 7 is a schematic sectional view illustrating the configuration of a fixing member further included in the exhaust structure for combustion apparatus according to the first embodiment.

Referring to FIG. 7, in the exhaust structure for combustion apparatus 100 of the present embodiment, a fixing member 80 is provided at a position closer to combustion apparatus 1 than to exhaust adapter 50 to fix one end of exhaust pipe 30, the other end of connection pipe 40, and exhaust tube 20 inserted into exhaust pipe 30 from one end to each other.

In FIG. 7, fixing member 80 has an annular shape surrounding a through hole into which exhaust tube 20 is introduced. Further, another through hole is provided in the region of the annular shape to allow connection pipe 40 to be introduced therein from the other end.

Thereby, region A can be separated from the indoor area, the exhaust gas flowing into region A can be guided into the inner space of connection pipe 40 and consequently into housing 9 more reliably. Further, exhaust tube 20 can be supported by fixing member 80, in other words, exhaust tube 20 can be supported by the two members of exhaust adapter 50 and fixing member 80. Therefore, exhaust tube 20 can be fixed more firmly.

From the consideration of air tightness, it is preferable that fixing member 80 is configured to allow exhaust tube 20, exhaust pipe 30 and connection pipe 40 to be fitted therein respectively. For example, fixing member 80 is preferably an elastic body made of an elastic material. Preferred elastic materials are soft resins listed as the preferred elastic materials for exhaust adapter 50.

Second Embodiment

The configuration of an exhaust structure for combustion apparatus according to a second embodiment serving as one embodiment of the present invention will be described with reference to FIGS. 8 to 10.

Figure 8:
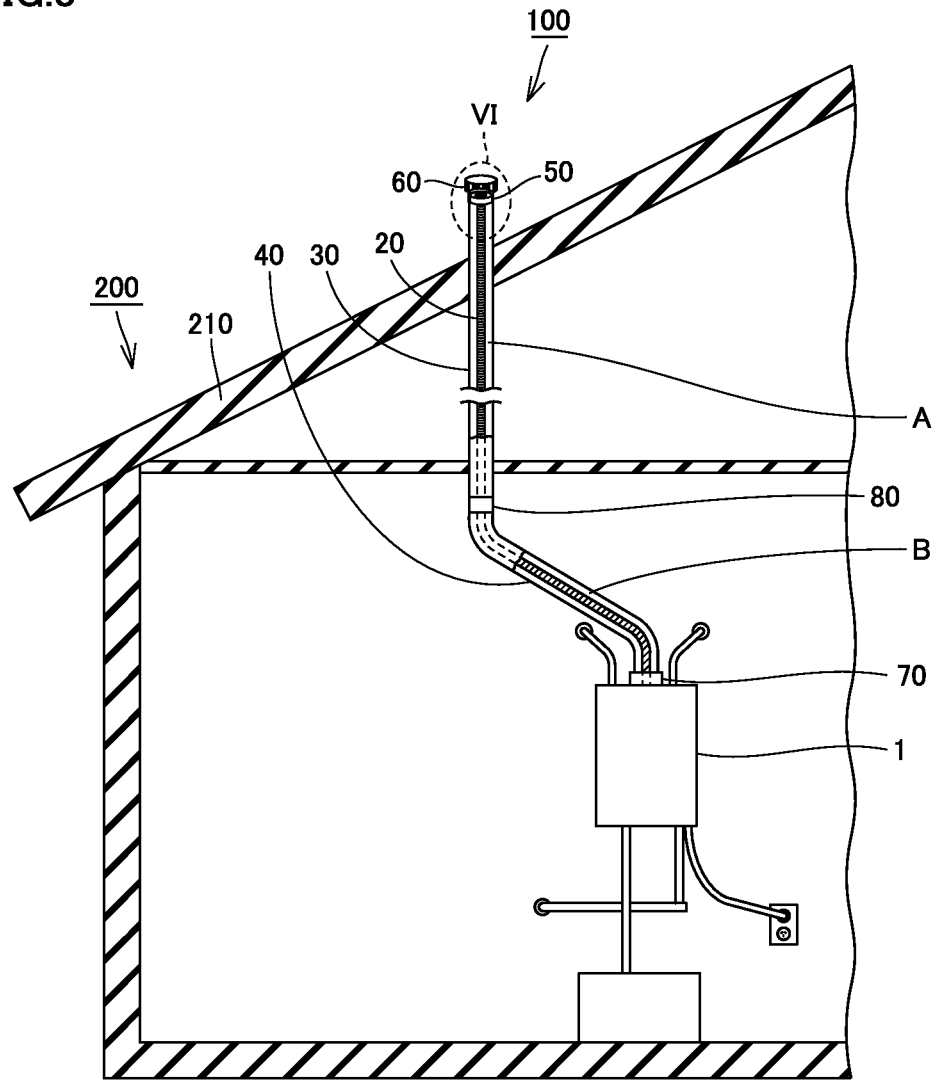
FIG. 8 is a schematic view schematically illustrating a state in which an exhaust structure for combustion apparatus according to a second embodiment is installed in a building.

Referring mainly to FIG. 8, the exhaust structure for combustion apparatus 100 of the present embodiment mainly includes combustion apparatus 1, exhaust tube 20, exhaust pipe 30, connection pipe 40, exhaust adapter 50, exhaust terminal 60, exhaust member 70, and fixing member 80. This exhaust structure for combustion apparatus 100 of the second embodiment is similar to the exhaust structure for combustion apparatus according to the first embodiment except that connection pipe 40, connection member 9*a* of combustion apparatus 1 connected to connection pipe 40, and fixing member 80 are different from those in the exhaust structure for combustion apparatus according to the first embodiment. Hereinafter, the differences to the first embodiment will be mainly described.

Figure 9:
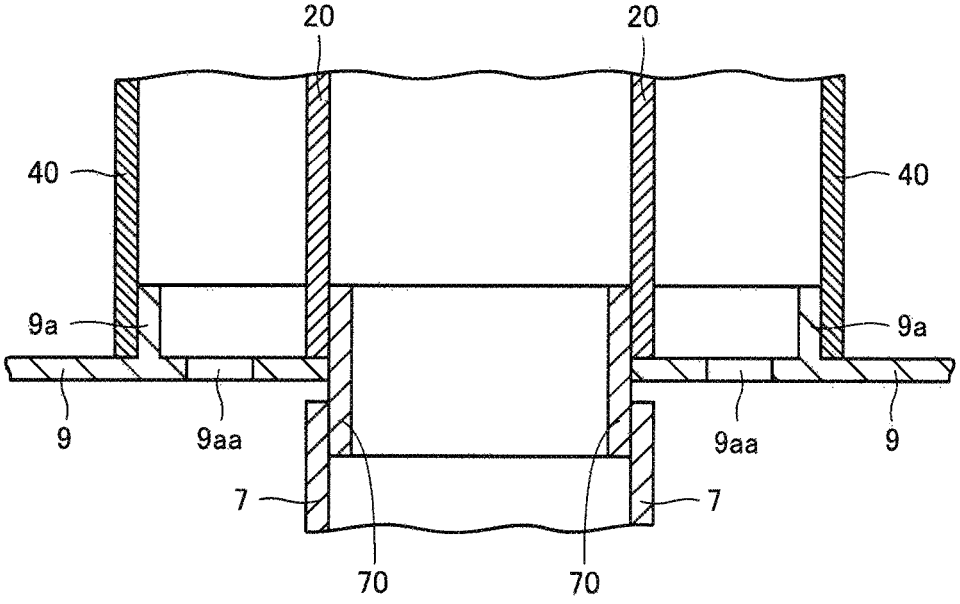
FIG. 9 is a schematic sectional view illustrating the configurations of an exhaust member and a connection member included in the combustion apparatus for exhaust structure according to the second embodiment.
Figure 10:
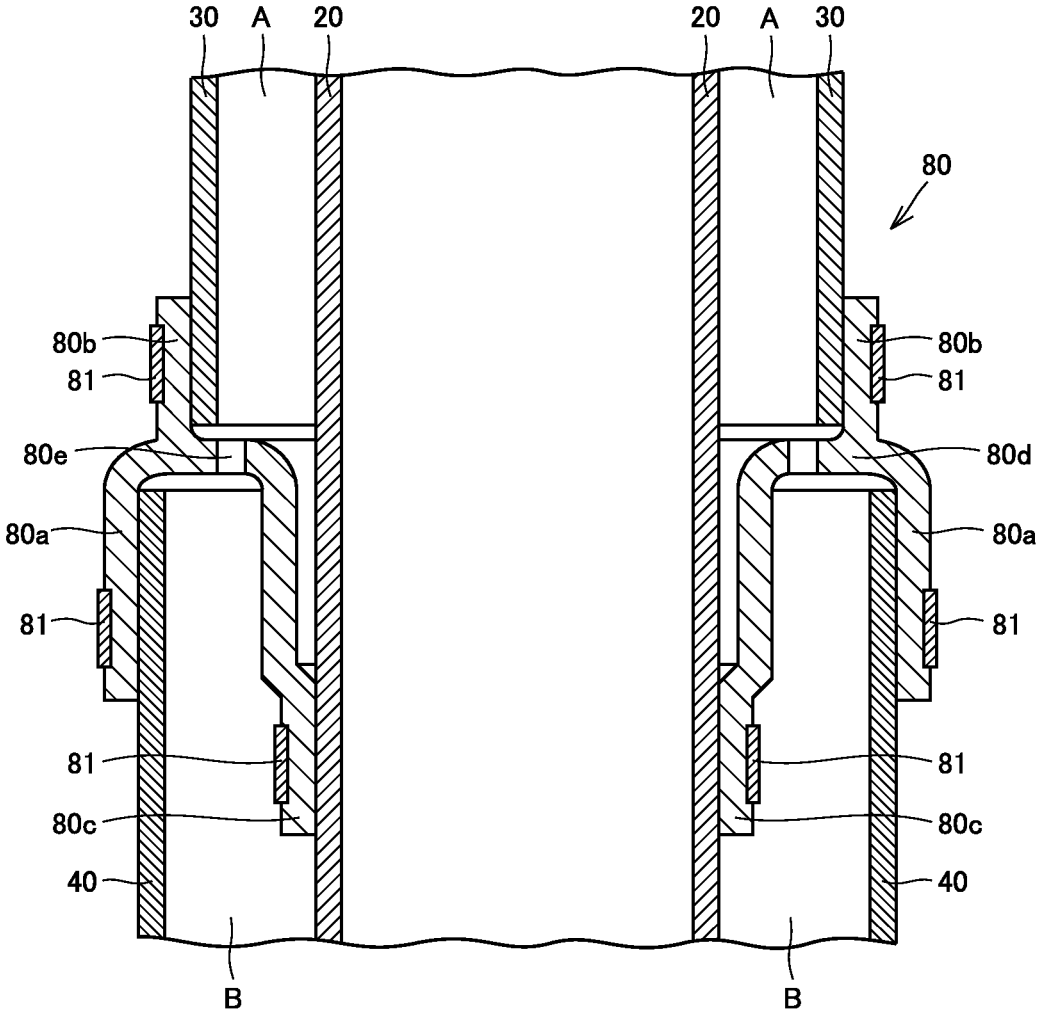
FIG. 10 is a schematic sectional view illustrating the configuration of a fixing member further included in the exhaust structure for combustion apparatus according to the second embodiment.

Referring mainly to FIGS. 8 to 10, connection pipe 40 has one end (the lower end in FIG. 8) and the other end (the upper end in FIG. 8). One end of exhaust tube 20 (the lower end in FIG. 8) is introduced inside connection pipe 40. Connection pipe 40 is connected to connection member 9*a* of combustion apparatus 1 at one end (see FIG. 9), and is connected to fixing member 80 at the other end (see FIG. 10). In other words, in the present embodiment, exhaust tube 20 and connection pipe 40 form a double-pipe structure.

Referring mainly to FIG. 9, the upper surface of housing 9 of combustion apparatus 1 is disposed with a plurality of connection ports 9*aa* and a tubular connection member 9*a* surrounding the plurality of connection ports 9*aa* and protruding from the upper surface of housing 9 to the outside of housing 9. Connection member 9*a* is connected to connection pipe 40, and thereby, the inner space of connection pipe 40 and the inner space of housing 9 (i.e., the inner space of combustion apparatus 1) are communicated. Connection port 9*aa* may be provided as one port or an annular hole.

In the present embodiment, as described above, connection pipe 40 and exhaust tube 20 form a double-pipe structure. Therefore, exhaust member 70 connected to exhaust tube 20 and connection member 9*a* connected to connection pipe 40 also form a double-pipe structure.

Referring mainly to FIG. 10, fixing member 80 includes a first fixing part 80*a* having a tubular shape and protruding downward in the drawing, a second fixing part 80*b* having a tubular shape and protruding upward in the drawing, a third fixing part 80*c* having a tubular shape and protruding downward in the figure inner to the inner circumferential surface of first fixing part 80*a*, and a joining part 80*d* joining the first to third fixing parts 80*a* to 80*c*. Joining part 80*d* is disposed with a communication hole 80*e* communicating a region between the inner circumferential surface of first fixing part 80*a* and the outer circumferential surface of third fixing part 80*c* to a region inside second fixing part 80*b*.

Connection pipe 40 is introduced into the region between the inner circumferential surface of first fixing part 80*a* and the outer circumferential surface of third fixing part 80*c* from the other end (upper end) thereof, and the inner circumferential surface of first fixing part 80*a* and the outer circumferential surface of connection pipe 40 are in close contact at the other end. Exhaust pipe 30 is introduced inside the inner circumferential surface of second fixing part 80*b* from one end (lower end) thereof and the inner circumferential surface of second fixing part 80*b* and the inner circumferential surface of exhaust pipe 30 are in close contact at the other end. Exhaust tube 20 is introduced into a through hole surrounded by third fixing part 80*c*, and the inner circumferential surface of third fixing part 80*c* and the outer circumferential surface of exhaust tube 20 are in close contact.

The above-described configuration can be readily achieved, for example, by preparing fixing member 80 from an elastic material. This elastic material is for example preferably a soft resin, and those materials listed in the first embodiment for exhaust adapter 50 can be suitably adopted. As illustrated in FIG. 10, the two members may be brought into closer contact to each other by using a binding band 81.

With the abovementioned configuration, the other end (the upper end) of connection pipe 40 and one end (lower end) of exhaust pipe 30 are fixed to each other by fixing member 80. Further, exhaust tube 20 surrounded by connection pipe 40 and exhaust pipe 30 is also fixed by fixing member 80. Furthermore, a region B (see FIG. 10) between the inner circumferential surface of connection pipe 40 and the outer circumferential surface of exhaust tube 20 can be made to communicate with region A between the inner circumferential surface of exhaust pipe 30 and outer circumferential surface of exhaust tube 20 through a communication hole 80*e* provided in joining part 80*d* of fixing member 80.

Then, the functions and effects of the exhaust structure for combustion apparatus of the present embodiment will be described.

Similar to the first embodiment, in the present embodiment, due to the provision of exhaust adapter 50, it is possible to alleviate the load on combustion apparatus 1, and suppress the reverse flowing of the exhaust gas and the entrance of the rain water. Even in the case where the part of exhaust tube 20 which has been introduced inside exhaust pipe 30 is damaged, the exhaust gas leaked from exhaust tube 20 into region A can be guided into the inner space of housing 9. Therefore, according to the exhaust structure for combustion apparatus 100 of the present embodiment, even in the case where exhaust tube 20 introduced into exhaust pipe 30 is damaged or the like, it is still possible to prevent the exhaust gas from leaking into the room.

Further, according to the present embodiment, the other part of exhaust tube 20 exposed from exhaust pipe 30 is introduced inside connection pipe 40 from one end. That is to say, the part of exhaust tube 20 close to one end thereof is positioned in the inner space of connection pipe 40. According to this configuration, even in the case where the part of exhaust tube 20 close to one end thereof is damaged, the exhaust gas leaked from exhaust tube 20 into region B can be guided into the inner space of housing 9 via the inner space of connection pipe 40. Therefore, according to the exhaust structure for combustion apparatus 100 of the present embodiment, even in the case where the part of exhaust tube 20 which is not introduced into exhaust pipe 30 is damaged, the exhaust gas can be prevented from leaking into the room.

Moreover, the exhaust structure for combustion apparatus 100 of the present embodiment is provided with fixing part 80, and thereby exhaust tube 20 can be supported by the two members of exhaust adapter 50 and fixing member 80. Therefore, not only exhaust tube 20 but also connection pipe 40 can be fixed more firmly.

Furthermore, in the case where exhaust tube 20 is made of a resin material, depending on the material, exhaust tube 20 may be deteriorated by ultraviolet rays. In this regard, according to the exhaust structure for combustion apparatus 100 of the present embodiment, since the part of exhaust tube 20 close to one end thereof is covered by connection pipe 40 on its outer circumferential surface, the ultraviolet rays are blocked, and thus, exhaust tube 20 can be prevented from being deteriorated by ultraviolet rays.

In addition, since exhaust tube 20 is covered by connection pipe 40, the external pressure can be avoided from being applied directly to exhaust tube 20 through connection pipe 40. In other words, connection pipe 40 can function as a protecting member for exhaust tube 20.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An exhaust structure for combustion apparatus, comprising:

a combustion apparatus including a combustor unit configured to produce combustion gas, a blower unit configured to supply air for combustion to said combustor unit, and a housing configured to house therein said combustor unit and said blower unit; \ an exhaust tube having one end and the other end, and connected to said combustion apparatus at the one end;

an exhaust pipe configured to allow a part of said exhaust tube to be introduced therein from the other end;

an exhaust adapter having an annular shape surrounding a through hole, attached to an outer circumferential surface of said exhaust tube by fitting said exhaust tube into said through hole, and attached to an inner circumferential surface of said exhaust pipe;

a connection pipe configured to communicate a region between the outer circumferential surface of said exhaust tube and the inner circumferential surface of said exhaust pipe to an inner space of said combustion apparatus; and an exhaust member connected between said combustion apparatus and said one end of said exhaust tube, wherein said housing of said combustion apparatus is provided with a connection member for connecting said connection pipe, said region located between said outer circumferential surface of said exhaust tube and said inner circumferential surface of said exhaust pipe is positioned closer to said combustion apparatus than to said exhaust adapter, said region located between said outer circumferential surface of said exhaust tube and said inner circumferential surface of said exhaust pipe is fluidly isolated from a region within the exhaust tube and the outdoors, said connection pipe is formed of a different member from said exhaust tube and said exhaust pipe, and in the event there is a leak in the exhaust tube, exhaust gas in said region between said outer circumferential surface of said exhaust tube and said inner circumferential surface of said exhaust pipe is guided into an inner space of said housing via said connection pipe.

2. The exhaust structure for combustion apparatus according to claim 1, wherein said connection pipe is configured to allow a part of said exhaust tube to be introduced therein from said one end, said connection member is disposed so as to surround said exhaust member.

3. The exhaust structure for combustion apparatus according to claim 1, wherein said connection pipe is flexible.

4. The exhaust structure for combustion apparatus according to claim 1, further comprising a fixing member configured to fix said exhaust pipe and said exhaust tube to each other, wherein said fixing member is connected by said connection pipe, and is provided with a communication hole configured to communicate said region between the outer circumferential surface of said exhaust tube and the inner circumferential surface of said exhaust pipe to an inner space of said connection pipe.

5. The exhaust structure for combustion apparatus according to claim 1, wherein said combustion apparatus is a water heater of an exhaust suction and combustion type.

6. The exhaust structure for combustion apparatus according to claim 2, wherein said connection pipe is flexible.

7. The exhaust structure for combustion apparatus according to claim 2, further comprising a fixing member configured to fix said exhaust pipe and said exhaust tube to each other, wherein said fixing member is connected by said connection pipe, and is provided with a communication hole configured to communicate said region between the outer circumferential surface of said exhaust tube and the inner circumferential surface of said exhaust pipe to an inner space of said connection pipe.

8. The exhaust structure for combustion apparatus according to claim 2, wherein said combustion apparatus is a water heater of an exhaust suction and combustion type.

9. The exhaust structure for combustion apparatus according to claim 3, further comprising a fixing member configured to fix said exhaust pipe and said exhaust tube to each other, wherein said fixing member is connected by said connection pipe, and is provided with a communication hole configured to communicate said region between the outer circumferential surface of said exhaust tube and the inner circumferential surface of said exhaust pipe to an inner space of said connection pipe.

10. The exhaust structure for combustion apparatus according to claim 3, wherein said combustion apparatus is a water heater of an exhaust suction and combustion type.

11. The exhaust structure for combustion apparatus according to claim 4, wherein said combustion apparatus is a water heater of an exhaust suction and combustion type.

* * * * *